United States Patent [19]

Rakach et al.

[11] Patent Number: 4,612,989

[45] Date of Patent: Sep. 23, 1986

[54] COMBINED REPLACEMENT DRIVE PROCESS FOR OIL RECOVERY

[75] Inventors: Alec Rakach, Sandnes, Norway; Caurino C. Bombardieri, Calgary, Canada

[73] Assignee: Exxon Production Research Co., Houston, Tex.

[21] Appl. No.: 740,607

[22] Filed: Jun. 3, 1985

[51] Int. Cl.[4] ..... E21B 43/00; E21B 43/24; E21B 43/26

[52] U.S. Cl. ..... 166/263; 166/271; 166/272

[58] Field of Search ..... 166/263, 271, 272

[56] References Cited

U.S. PATENT DOCUMENTS

| | | | |
|---|---|---|---|
| 3,259,186 | 7/1966 | Dietz | 166/11 |
| 3,280,909 | 10/1966 | Closmann et al. | 166/2 |
| 3,354,954 | 11/1967 | Buxton | 166/11 |
| 3,367,419 | 2/1968 | Lookeren | 166/11 |
| 3,420,298 | 1/1969 | Cornelius | 166/11 |
| 3,796,262 | 3/1974 | Allen et al. | 166/272 |
| 3,845,817 | 11/1974 | Hoyt et al. | 166/245 |
| 4,121,661 | 10/1978 | Redford | 166/252 |
| 4,130,163 | 12/1978 | Bombardieri | 166/252 |
| 4,182,416 | 1/1980 | Trantham et al. | 166/245 |

*Primary Examiner*—Stephen J. Novosad
*Assistant Examiner*—Bruce M. Kisliuk
*Attorney, Agent, or Firm*—James H. Riley; Karen T. Burleson

[57] ABSTRACT

Performing steam drive operations in critical manipulative steps can improve the recovery of viscous hydrocarbons from tar sand deposits. Steam is injected into an injection well at a rate that is less than the rate needed to fracture the formation, and fluids are simultaneously produced from a communicating production well. When steam breakthrough occurs at the production well, the production well is shut-in, and the injection rate is increased to a rate at least sufficient to fracture the formation. After the reservoir is sufficiently heated, injection ceases and production resumes. Once the production rate declines to a rate that is no longer efficient, the process can be repeated.

12 Claims, 4 Drawing Figures

COMBINED REPLACEMENT DRIVE PROCESS FOR OIL RECOVERY

BACKGROUND OF THE INVENTION

1. Field of the Invention

This invention relates to a process for extracting hydrocarbons from the earth. More particularly, this invention relates to a method for recovering especially viscous hydrocarbons, e.g. bitumen, from a subterranean formation using at least two wells for injection and production, and which includes critical manipulative steps with heated fluid.

2. Description of the Prior Art

In many areas of the world, there are large deposits of viscous petroleum, such as the Cold Lake, Athabasca and Peace River regions in Canada, the Jobo region in Venezuela and the Edna and Sisquoc regions in the United States. These deposits are generally called "tar sand" and "heavy oil" deposits due to the high viscosity of the hydrocarbons which they contain and may extend for many miles and occur in varying thickness of up to more than 300 feet. Although these deposits may lie at or near the earth's surface, generally they are located under a substantial overburden which may be as great as several thousand feet thick. Tar sands located at these depths constitute some of the world's largest presently known petroleum deposits.

The tar sands contain viscous hydrocarbon material, commonly referred to as bitumen, in an amount which ranges from about 5 to about 20 percent by weight. Bitumen is usually immobile at typical reservoir temperatures. For example, at reservoir temperatures of about 48° F., bitumen viscosity frequently exceeds several thousand poises. At higher temperatures, such as temperatures exceeding 200° F., bitumen generally becomes mobile with a viscosity of less than 345 centipoises.

Since most tar sand deposits are too deep to be mined economically, a serious need exists for an in situ recovery process wherein the bitumen is separated from the sand in the formation and recovered through production means, e.g. wells drilled into the deposit.

In situ recovery processes known in the art include emulsification drive processes, thermal techniques (such as fire flooding), in situ combustion, steam flooding and combinations of these processes.

Any in situ recovery process must accomplish two functions: (1) the viscosity of the bitumen must be reduced to a sufficiently low level to mobilize, e.g. fluidize, the bitumen under the conditions prevailing; and (2) sufficient driving energy must be applied to that treated bitumen to induce it to move through the formation to a production well.

As previously noted, among the various methods that have been proposed for recovering bitumen in tar sand deposits are heating techniques. Because steam is generally the most economical and efficient thermal energy agent, it is clearly the most widely employed.

Several steam injection processes have been suggested for heating the bitumen. One method involves a steam stimulation technique commonly called the "huff and puff" process. In such a process, steam is injected into a well for a certain period of time. The well is then shut in to permit the steam to heat the oil. Subsequently, formation fluids, including bitumen, water and steam, are produced from the well. Production is later terminated and steam injection is preferably resumed for a further period. Steam injection and production are alternated for as many cycles as desired. A principle drawback to the "huff and puff" technique is that it does not heat the bulk of the oil in the reservoir and consequently reduces the oil recovery.

Another method of recovering viscous petroleum materials from subterranean formations is through the use of thermal drive techniques. Typically, thermal drive techniques employ an injection well and a production well which extend into the reservoir formation. In operation, a hot fluid (usually steam) is introduced into the formation through the injection well. Upon entering the formation, the hot flowing fluid lowers the viscosity of the petroleum materials therein and subsequently drives the lower viscosity fluid to a production well.

It has been found that conventional thermal drive processes generally are not commercially effective in recovering bitumen from tar sands. The basic problem in high viscosity hydrocarbon formations, such as tar sands, is restricted fluid mobility in the reservoir. One reason for this is that the bitumen tends to cool and increase in viscosity as it moves away from the injection well where the steam or hot fluid is most effective. Once the bitumen attains a high enough viscosity, it banks up and forms an impermeable barrier to further flow toward production wells.

Another problem with steam drive is that the driving force of the steam flooding technique is ultimately lost when breakthrough occurs at the production well. Steam breakthrough occurs when the steam front advances to a production well and steam pressure is largely dissipated through the production well. Fluid breakthrough causes a loss of steam driving pressure characterized by a marked diminuation in the efficiency of the process. After steam breakthrough, the usual practice, as suggested in U.S. Pat. No. 3,367,419 (Lookeren) and U.S. Pat. No. 3,354,954 (Buxton), is to produce without steam drive until further steam injection is necessitated or production is terminated.

U.S. Pat. No. 3,259,186 (Dietz), for example, appears to have an early teaching of conventional "huff and puff." The patent discloses a method for recovering viscous oil from subterranean formations by simultaneously injecting steam into several adjacent injection wells to heat the formation. Formation fluids are then produced from the injection wells. After several cycles, steam drive can be established by injecting steam into one injection well while using another for production. U.S. Pat. No. 3,280,909 (Closmann, et al) discloses a conventional steam drive comprising steam injection to produce interconnecting fractures, but insufficient to produce oil, followed by steam drive at conventional pressures and rates.

Several variations of steam stimulation have been tried, each with its own distinct sequence of steps. U.S. Pat. No. 3,796,262 (Allen, et al) teaches a method of injecting steam at a rate greater than the production rate but less than the rate needed to fracture the formation. The injection is stopped when live steam breaks through to the production well, but production continues at a high rate until the pressure drops.

U.S. Pat. No. 4,182,416 (Trantham, et al) discloses a method of pattern injection and production wherein steam is injected at the injection wells until it breaks through to one of the production wells which is then shut-in while injection continues. Later, the injection well communicating with the production well is shut-in, and the production well is produced for a period of time.

Also, U.S. Pat. No. 4,130,163 (Bombardieri) teaches a method of simultaneous injection of steam into the injection and production wells. After the hydrocarbons are sufficiently mobilized, the injection well is shut-in, and the production well is opened. Finally, steam is again injected into the injection well, but at a restricted rate, to help drive the oil to the production well.

While all of the above methods are of interest, the technology has not generally enabled cost effective recovery of oil for commercial development of tar sands. There is a continuing need for an improved thermal system for effectively recovering viscous hydrocarbons from subterranean formations such as tar sand deposits.

SUMMARY OF THE INVENTION

The invention is a method of recovering oil from subterranean formations wherein there is at least one injection well and one production well which are in fluid communication with each other through said formation. A heated fluid, such as steam, is injected via the injection well at a rate which is less than what is necessary to fracture the formation. This rate varies with the formation conditions, but must be sufficient to drive the heated oil to the production well. When breakthrough of the heated fluid occurs, the production well is shut-in, and injection through the injection well is increased to a level which is at least sufficient to fracture the formation, i.e. the injection pressure is greater than the overburden pressure. After the reservoir is sufficiently heated, the injection well is shut-in and the production well is opened for production. Once the production rate declines below the rate that existed before breakthrough, the production well can be shut-in, and the injection process repeated.

By practicing the method according to the invention, viscous hydrocarbons are sufficiently fluidized to be induced to flow out to a formation while avoiding excessive losses of heat. The primary advantage of this invention over continuous injection is that the heat is more efficiently transmitted to the formation. Still another advantage is that the oil does not have to complete with the injected fluid for a flowing path to the producer.

DETAILED DESCRIPTION OF INVENTION

The essence of this invention is the discovery that production from viscous hydrocarbon formations can be improved by following a critical sequence of injection and production steps. After two wells are in communication through one or more heated channels, a heated fluid, such as steam, is injected into the injected well at a rate less than the rate needed to fracture the formation, and oil is produced from the production well until the heated fluid breaks through at the production well. After breakthrough, the production well is shut-in to prevent excessive losses of heat, and the injection rate is increased to a value at least sufficient to fracture the formation. After the formation is suitably heated, the injection well is shut-in, and the production well is reopened to production of the heated fluids.

Figure 1:
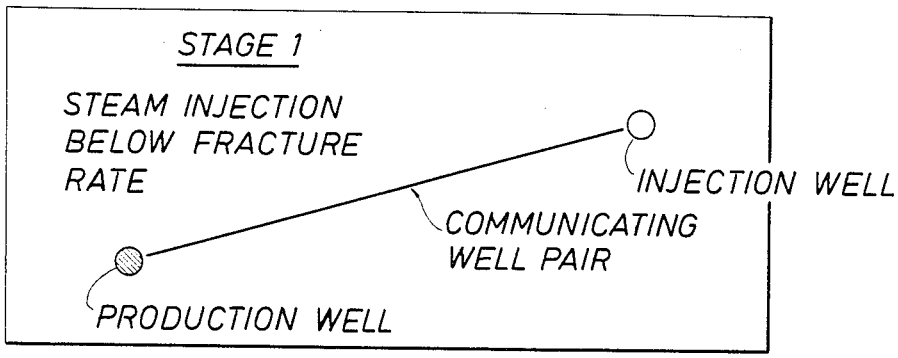
FIG. 1 is a diagrammatic representation of wells illustrating the state of two wells in the early stages of the process of this invention.
Figure 2:
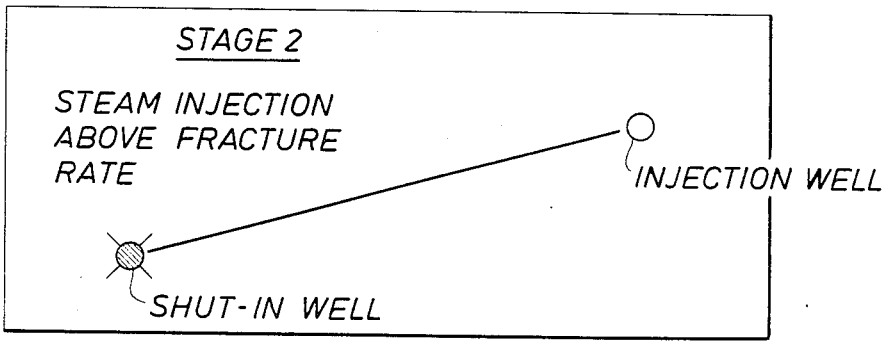
FIG. 2 is a diagrammatic representation similar to FIG. 1 illustrating the process of the invention at a later stage.
Figure 3:
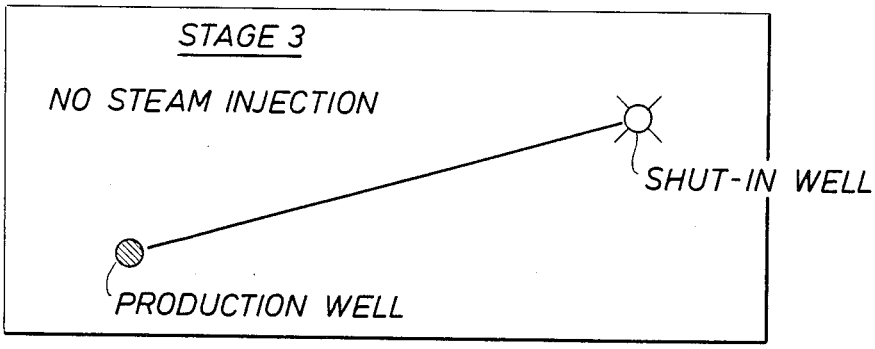
FIG. 3 is similar to FIGS. 1 and 2 and illustrates the process of the invention at still a later stage.

Referring to FIGS. 1 through 3 of the drawings, two wells are represented in varying phases of operation in the practice of the invention. The wells represented by a circle are injection wells, those which are solid circles are production wells, and those having a superimposed "x" mark are shut-in wells. While only two wells are illustrated in the drawings, it is understood that the invention is not limited to any particular number or pattern of wells.

A preferred embodiment of the invention is carried out in the following manner. Referring to FIG. 1, a heated fluid is injected into a viscous hydrocarbon formation through at least one well in said formation. Viscous hydrocarbons mobilized in the formation are produced at a second well. One well is referred to herein as an injection well, and the other well is referred to herein as a production well. In most cases, the injection of the hot fluid will occur simultaneously with the production of the mobilized hydrocarbons. This process continues until breakthrough of the heated fluid occurs at the production well.

As will be described in more detail later, a number of fluids can be used in the practice of this invention. However, steam is especially preferred because it is the most convenient to use. This embodiment will therefore be discussed in terms of steam although it is not so limited.

Initially, steam is injected into the formation at a rate which is less than the rate needed to fracture the formation and at a temperature in the range of about 465° F. to about 600° F., preferably about 500° F. to 550° F. Steam may be saturated or supersaturated. Generally, in most field applications the steam will be saturated with a quality of approximately 65 to 80 percent. Optimization of the injection rates, steam temperature and steam quality is well within the skill of petroleum engineers of ordinary skill in their art or can be readily determined by routine experimentation or computer modeling.

Steam may be injected into tubing or annulus depending on capacity of the steam system and type of well completion. Ordinarily, steam is injected either through the casing or through the tubing with a packer set between tubing and casing above the pay. With the latter arrangement, heat losses, increases in casing temperature, and resulting thermal stresses are minimized. The injection period varies between 45 to 75 days depending on the permeability of the reservoir and the boiler capacity. In any event, treatment time can be readily determined by one skilled in the art or by actual experience in a particular field.

During this first stage, production of fluids from the production well is not restricted, and fluid production is allowed to proceed without restriction so long as only liquids are produced at the production well. Once live or vapor phase steam breaks through at the production well, the first stage is ended and the second stage is begun.

Referring to FIG. 2 for the second stage, the production well is shut-in, and the rate of steam injection into the injection well is increased to a rate at least sufficient to fracture the formation. An injection rate of 5000 to 25,000, preferably 10,000 to 20,000, pounds of steam per hour is often satisfactorily for formations ranging in depth from 1200 to 1700 feet. Another way of expressing the injection rate is: 400 to 800 pounds per foot of open interval in the well. These high rates of injection result in the fracturing of the formation. By ceasing production and increasing the injection rate of steam, the formation is heated more efficiently than with other methods.

Several factors affect the volume of steam injection. Among these are the thickness of the hydrocarbon containing formation, the viscosity of the oil, the porosity of the formation, amount of formation face exposed and the saturation level of the hydrocarbon and water in the formation. Generally, the total steam volume injected during this step will vary between 30,000 to 60,000 barrels. Moreover, the steam may be mixed with other fluids, e.g. gases or liquids, to increase its heating efficiency. It may also be mixed with air and other oxygen containing gases to utilize a combustion front.

Steam is ideal for raising the temperature of a reservoir because of its high heat content per pound. Saturated steam at 350° F. contains 1192 BTU per pound compared with water at 350° F. which has only 322 BTU per pound or only about ¼ as much as steam. The big difference in heat content between the liquid and the steam phases is the latent heat or heat of vaporization. Because the amount of heat released when steam condenses is very large, oil reservoirs can be heated much more efficiently by steam than by either hot liquids or noncondensable gases.

Generally, the formation should be heated radially at least 10 feet and up to 150 feet from each wellbore. Because the producing well has been shut-in during the second phase, the reservoir temperature and pressure are simultaneously increased.

The steam to be used in our invention is preferably of the highest quality available. As the injection pressure increases due to increased reservoir pressure, the steam generator conditions are adjusted to maintain high quality steam output.

Referring to FIG. 3 for the third stage, after the formation around the wells has been suitably heated, steam injection into the well is discontinued, and the production well is opened to production of the heated fluids. The removal of hydrocarbons from the formation via the production well may be accomplished by any of the known methods. The lifting of the hydrocarbons to the surface may also be effected by pumping or gas lifting. The recovery apparatus is not described in detail because such production methods are well known.

During stage three, production will continue in the production well at a declining rate over a given production cycle. The pressure within that part of the formation which is in contact with the steam gradually reduces to a value that is lower than the fracture pressure of the formation. When the production rate declines below the rate that existed during stage one, stage two can be repeated to increase the rate of production.

It is desirable that pressure and temperature measuring devices be placed in the bottom of the wells to record this information during shut-in and production periods. These pressure and temperature devices can be monitored to determine when each stage should be begun. During oil production, the actual production rates will be an additional factor in determining when the process should be repeated.

The term "heated fluid" as used herein is understood to means a fluid having a temperature considerably higher than the temperature of the formation into which it is injected (e.g. 150° F. to 1,000° F.) It could be heated gas or liquid, such as steam or hot water, and it could contain surfactants, solvents, oxygen, air, inert inorganic gases, and hydrocarbon gases.

Although the heated fluid in the initial and subsequent injection sequences described above was steam, these fluids may differ. For example, the initially injected fluid may be steam, and the second injected fluid may be hot water, or vice versa. As a further example, the initial fluid may be hot water, and the subsequent fluid may be superheated steam. Any suitable agent for increasing the mobility of the viscous hydrocarbons may be added to the heated fluid. The method of the present invention is not restricted to a particular well pattern, but it can be employed in oil fields in which the wells are arranged according to previously existing patterns. The injection, shut-in and production periods for two equivalent sets of wells may coincide.

While this steam injection process is particularly suitable for thick deposits of heavy viscous hydrocarbons, such as bitumen and tar sands, it should be understood that this invention may be employed to recover hydrocarbons of much higher API gravity, e.g. 25° to 40° API. Thus, it is also within the scope of this invention to employ the method described herein to recover liquids from any subterranean strata which may be thermally stimulated.

ACTUAL FIELD EXAMPLES

The invention is further illustrated by referring to the following examples based on field tests which are offered only as illustrative embodiment of the invention and are not intended to be limited or restrictive thereof. An index for comparing the performance of several experimental sites is provided in the following tables I and II:

TABLE I

| | STEAM FLOODING | | |
|---|---|---|---|
| TEST SITE | OSR | WOR | CDOR |
| A | 0.13 | 5.43 | 4.81 |
| B | 0.30 | 3.31 | 6.83 |
| C | 0.13 | 8.52 | 4.49 |
| D | 0.10 | 10.92 | 3.10 |
| E | 0.26 | 2.56 | 9.66 |

TABLE II

| | COMBINED REPLACEMENT DRIVE | | |
|---|---|---|---|
| TEST SITE | OSR | WOR | CDOR |
| A | 0.15 | 5.21 | 5.01 |
| B | 0.31 | 3.28 | 6.90 |
| C | 0.15 | 7.91 | 4.98 |
| D | 0.10 | 10.97 | 3.21 |
| E | 0.28 | 2.87 | 9.90 |

OSR = Oil/Stream Ratio
WOR = Water/Oil Ratio
CDOR = Cumulative Daily Oil Recovery ($m^3$/day)

Tests A through D were conducted at May pilot project, Cold Lake, Alberta, and test E was conducted at Leming pilot project, Cold Lake, Alberta. Test A and B each used one injection well and two production wells, and test C, D, and E used one injection well and one production well. Test periods ranged from six months to three years.

Figure 4:
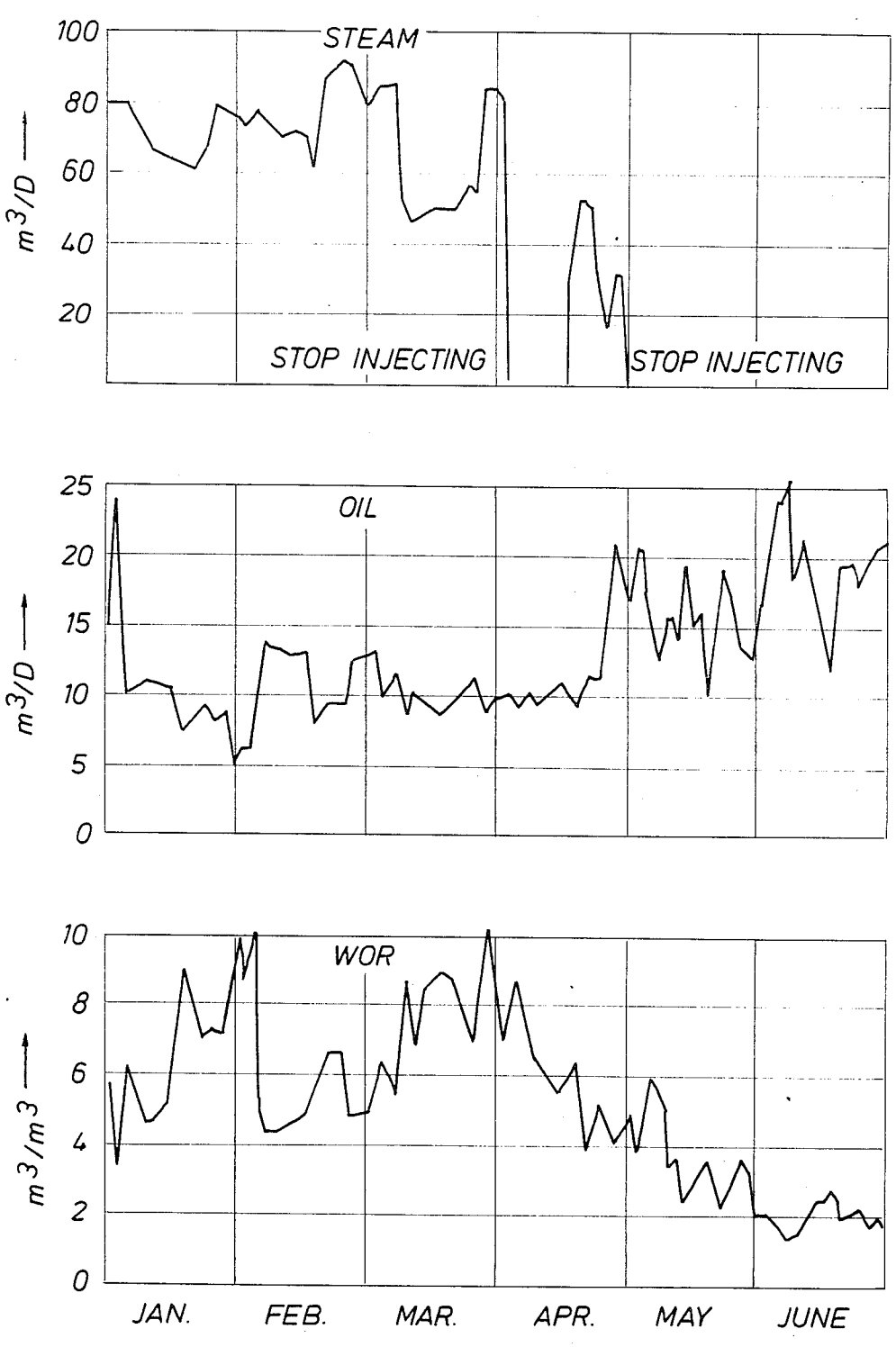
FIG. 4 is a graphic illustration of the injection and production results in an actual field test of the invention.

Tables I and II show the cumulative production data for the test sites and do not show the large differences that can occur over shorter periods of time. FIG. 4, on the other hand, details the production performance of test site B over a six-month period. The increase in oil recovery when steam injection ceased is particularly significant.

The principle of the invention and the best modes in which it is contemplated to apply that principal have been described. It is to be understood that the foregoing is illustrative only and that other means and techniques can be employed without departing from the true scope of the invention as described in the following claims.

What we claim is:

1. In a process for recovering hydrocarbons from a subterranean hydrocarbon-bearing formation which is penetrated by at least one injection well and at least one production well wherein a heated fluid is injected into said hydrocarbon formation through said injection well and fluids are produced from said production well, the improvement which comprises the following sequence of steps:

(a) injecting said heated fluid through said injection well at a rate less than the rate needed to fracture said formation and producing fluids from said production well until said heated fluid breaks through to said production well;

(b) shutting in said production well after said heated fluid from said injection well breaks through to said production well;

(c) injecting heated fluid into said injection well at a rate at least sufficient to fracture said formation;

(d) ceasing injection of said heated fluid after said formation is suitably heated; and (e) opening said production well and producing hydrocarbons from said production well.

2. A process as described in claim 1 further comprising ceasing production at said production well when the production rate adversely declines and repeating steps (c), (d) and (e).

3. A process as described in claim 1 wherein said formation is heated radially from about 10 feet and to about 150 feet from such wellbore while said production well is shut-in.

4. A process as described in claim 1 wherein said heated fluid is steam.

5. A process as described in claim 4 wherein said steam ranges in temperature from about 465° F. to about 600° F.

6. A process as described in claim 4 wherein the injection rate during step (c) is from about 5000 to about 25,000 pounds of steam per hour.

7. A process as described in claim 4 wherein the amount of steam injected during step (c) is from about 30,000 to about 60,000 barrels.

8. In a process for recovering hydrocarbons from a subterranean hydrocarbon-bearing formation which is penetrated by at least one injection well and at least one production well wherein steam is injected into said hydrocarbon formation through said injection well and fluids are produced from said production well, the improvement which comprises the following sequence of steps:

(a) injecting said steam through said injection well at a rate less than the rate needed to fracture said formation and producing fluids from said production well until said steam breaks through to said production well;

(b) shutting in said production well after said steam from said injection well breaks through to said production well;

(c) injecting steam into said injection well at a rate at least sufficient to fracture said formation;

(d) ceasing injection of said steam after said formation is suitably heated;

(e) opening said production well and producing hydrocarbons from said production well; and (f) ceasing production at said production well when the production rate adversely declines and repeating steps (c), (d) and (e).

9. A process as described in claim 8 wherein said formation is heated radially from about 10 feet and to about 150 feet from such wellbore while said production well is shut-in.

10. A process as described in claim 8 wherein said steam ranges in temperature from about 465° F. to about 600° F.

11. A process as described in claim 8 wherein the injection rate during step (c) is from about 5000 to about 25,000 pounds of steam per hour.

12. A process as described in claim 8 wherein the amount of steam injected during step (c) is from about 30,000 to about 60,000 barrels.

* * * * *